United States Patent [19]

O'Brien

[11] Patent Number: 4,586,993

[45] Date of Patent: May 6, 1986

[54] CONTROL OF SULFATES IN MEMBRANE CELL CHLOR-ALKALI PROCESS

[75] Inventor: Thomas F. O'Brien, Media, Pa.

[73] Assignee: Stearns Catalytic World Corporation, Denver, Colo.

[21] Appl. No.: 739,730

[22] Filed: May 31, 1985

[51] Int. Cl.[4] ..... C25B 1/16

[52] U.S. Cl. ..... 204/98; 204/128

[58] Field of Search ..... 204/98, 128; 210/723, 210/726, 727, 729

[56] References Cited

U.S. PATENT DOCUMENTS

| | | | |
|---|---|---|---|
| 2,753,242 | 7/1956 | Davis | 204/98 |
| 2,902,418 | 9/1959 | Burns | 204/98 |
| 3,970,528 | 7/1976 | Zirngiebl et al. | 204/98 |
| 3,998,709 | 12/1976 | Winkler | 204/98 |
| 4,078,978 | 3/1978 | Zirngiebl | 204/98 |
| 4,176,022 | 11/1979 | Darlington | 204/98 |
| 4,277,447 | 7/1981 | Chambers et al. | 204/98 |
| 4,488,949 | 12/1984 | Lee et al. | 204/98 |

FOREIGN PATENT DOCUMENTS

| | | | |
|---|---|---|---|
| 2448531 | 4/1976 | Fed. Rep. of Germany | 204/98 |
| 2709728 | 9/1978 | Fed. Rep. of Germany | 204/98 |
| 4927278 | 7/1974 | Japan | 204/98 |
| 422689 | 1/1935 | United Kingdom | 204/98 |

*Primary Examiner*—John F. Niebling
*Assistant Examiner*—Terryence Chapman
*Attorney, Agent, or Firm*—Carol A. Nemetz; James C. Simmons; E. Eugene Innis

[57] ABSTRACT

Method of addition of calcium ions to salt-depleted brine prior to resaturation, wherein the concentration of sulfate impurity is controlled. The invention relates to a process for the electrolysis of aqueous alkali metal chloride solutions to produce chlorine and high purity alkali metal hydroxide solutions.

9 Claims, 1 Drawing Figure

BRINE LOOP IN CHLOR-ALKALI PLANT

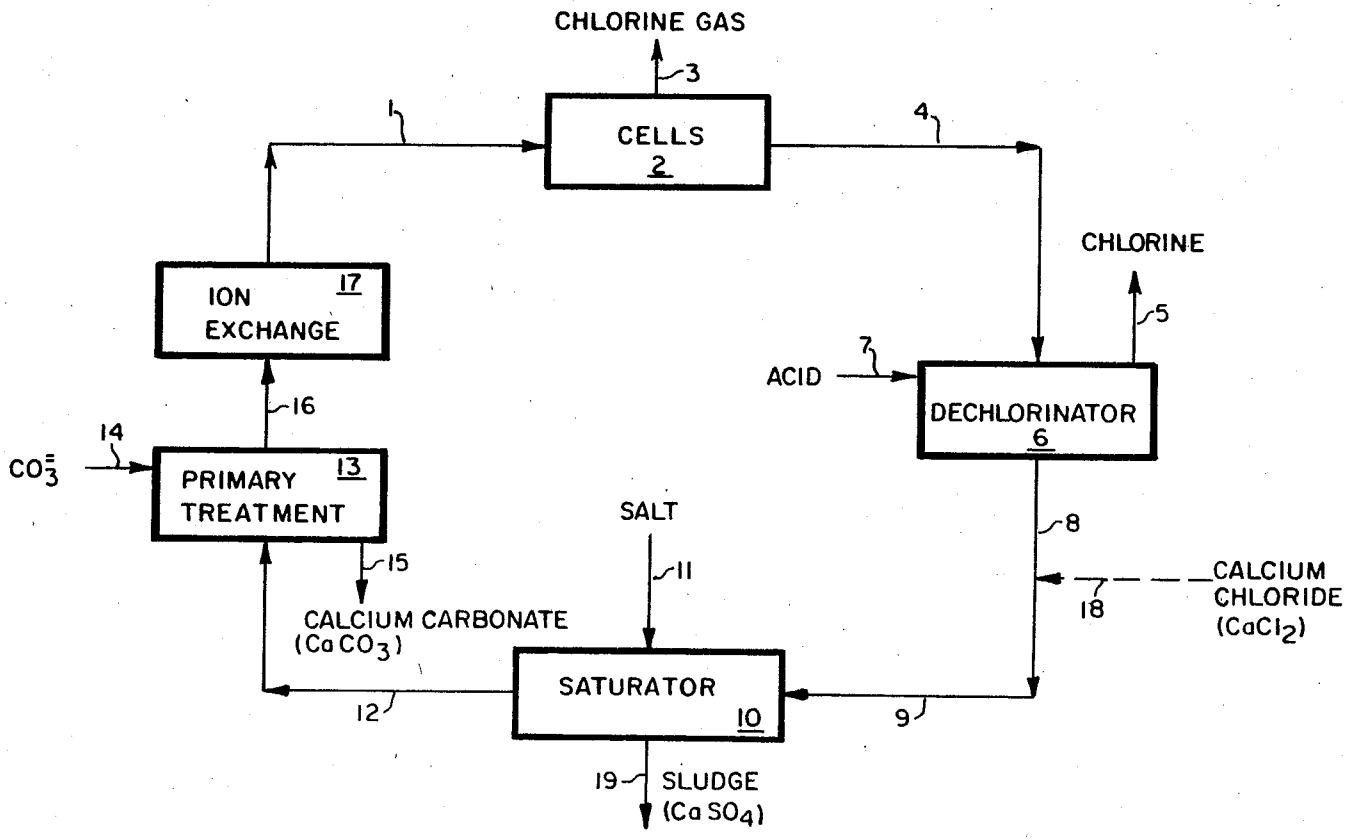
BRINE LOOP IN CHLOR-ALKALI PLANT

CONTROL OF SULFATES IN MEMBRANE CELL CHLOR-ALKALI PROCESS

TECHNICAL FIELD

The present invention relates to a process for the electrolysis of aqueous alkali metal chloride solutions to produce chlorine and high purity alkali metal hydroxide solutions. More specifically, the present invention is directed toward a method of the addition of calcium ions to salt-depleted brine prior to resaturation, wherein the concentration of sulfate impurity is controlled.

BACKGROUND OF INVENTION

Electrolytic cells that are commonly employed commercially for the conversion of alkali metal chloride into alkali metal hydroxide and chlorine may be considered to fall into the three following general types: diaphragm, mercury, and membrane cells. The present invention relates to membrane cells.

Membrane cells utilize one or more membranes or barriers separating the catholyte and the anolyte compartments. The membranes are permselective, that is, they are selectively permeable to either anions or cations. Generally, the permselective membranes utilized are cationically permselective. The catholyte product of the membrane cells is a relatively high purity alkali metal hydroxide. The catholyte product, or cell liquor, from a membrane cell is purer and of a higher concentration than the product of a diaphragm cell.

Membrane-type chlor-alkali cells are sensitive to the presence of sulfate in the feed brine. Alkali metal sulfates migrate from the anolyte compartment through the membrane towards the catholyte compartment. At some concentration, the solubility of the sulfates will be exceeded in the highly alkaline environment of the catholyte compartment. When the sulfates reach a zone of sufficient alkalinity, they precipitate in the membrane, disrupting its structure. Concentrations higher than a few grams per liter in the anolyte compartment will cause deposition of sulfates in the membrane. The degradation of the membrane causes a gradual drop in the current efficiency of the membrane cell and results in the physical failure of the membrane.

This is a problem of fairly recent origin. Diaphragm and mercury cells, which have been the industry standard, are less sensitive to sulfates. The earliest commercial membrane cells were inherently less efficient than those based on today's membranes and so were less susceptible to more subtle effects.

Sulfate in the saturated brine solution originates primarily from calcium sulfate, either anhydrite or gypsum, which occurs naturally in rock salt deposits formed by the evaporation of inland seas and in solar salts. Sulfates may also be present in processed salts including evaporator, recrystallized, and purified vacuum salts. The rock salt may be mined and converted to brine solution in above-ground dissolvers or saturators. Alternatively, it may be dissolved underground by the injection of water or unsaturated brine. In either case, the resulting brine will contain calcium sulfate in quantities ranging upward to saturation. Additionally, sulfates can result from compounds other than calcium sulfate.

There are very few commercial examples of applied solutions to address the problem of controlling sulfate concentration. Two of the methods, purging and precipitation, attempt to remove the sulfate from the saturated brine.

Processes utilizing purge streams, without other treatment, may be costly. Due to the low selectivity of the purge process, the cost of the accompanying sodium chloride in the purge stream is high, and the total dissolved solids in the plant effluent may be intolerable.

Sulfates can be precipitated from the saturated brine by the addition of various compounds for example calcium chloride, barium chloride, or barium carbonate. Increasing the calcium concentration above that which resulted from initial dissolution of the calcium sulfate ($CaSO_4$) forces some of the sulfate out of solution as calcium sulfate. In the case of the addition of a barium compound, barium sulfate ($BaSO_4$), which is less soluble than calcium sulfate, is precipitated after treatment with calcium or barium. Sodium carbonate ($Na_2CO_3$) can be added, which in turn precipitates the excess calcium or barium as its respective carbonate. The carbonates are filtered off separately from or along with the sulfate. Finally, the brine is subject to an ion exchange treatment to remove last traces of added alkaline earth metal.

The use of barium is very effective in sulfate removal and allows the sulfate concentration to be reduced to very low values. However, this method has serious drawbacks. The cost of barium is high. It is recognized as a toxic substance and is slowly leachable from the precipitate, thereby necessitating special disposal measures. Additionally, the introduction of excess barium (or accompanying strontium) to a brine stream places an additional load on the brine softening process.

Precipitation of sulfate with calcium eliminates the toxicity problem but presents some of its own. $CaSO_4$ is much more soluble in water than is $BaSO_4$ (about 2 grams per liter versus 2 milligrams per liter). It is also salted in by sodium chloride (NaCl), being about three times as soluble in saturated brine as in water. Precipitation by calcium is, therefore, less effective than precipitation by barium.

The precipitation treatment procedures are also unsatisfactorily slow. The rate of crystallization of calcium sulfate or barium sulfate is low because of the low concentrations of the two reacting ions, and a relatively long time for precipitation must be allowed. The resulting precipitate may be extremely finely divided and difficult to settle or filter.

Precipitation requires more equipment and processing steps than the present invention. The sulfate must be precipitated and removed separately from the calcium to avoid redissolution of the sulfate. In a typical brine plant, this would mean the addition of a treatment tank. Other equipment would be needed for removal of the solids. Conventional practice is to use an open clarifier, which usually is the largest piece of equipment in the plant. The use of two clarifiers to remove different solids adds significantly to the area occupied by a plant.

Two other known commercial methods of controlling sulfate concentration are the use of "rapid" dissolvers and the use of additives in conventional dissolvers. Both, like the present invention, are intended to restrict the introduction of sulfates to the saturated brine.

The so-called rapid dissolvers take advantage of the relative kinetics of dissolution of NaCl and $CaSO_4$. The former dissolves much more rapidly than does the latter. If the salt is allowed only a limited time of contact with depleted brine, NaCl will dissolve selectively. The resultant solution will be essentially saturated with NaCl but far from saturated with $CaSO_4$. The disadvantages of this technique are its sensitivity to processing changes and to the physical form of the salt. Since salt residue must be removed continually, it is necessary to keep the flowrates of salt and depleted brine in close balance. If the operating rate of a plant is reduced, the flowrates of salt and of circulating depleted brine will also decrease. Unless compensating changes are made, the fraction of the $CaSO_4$ which dissolves will increase due to increased contact time between the salt and the depleted brine. This problem with varying process flowrates does not exist with conventional dissolvers or with the present invention. Rapid dissolution is not feasible if the salt is being dissolved in an underground mine.

Finally, the effectiveness of rapid dissolvers depends on the physical form of the salt. Natural salts will be either rock salts or solar salts. The sulfate content of the former tends to be present as discrete particles of anhydrous $CaSO_4$ (anhydrite) which are uniformly distributed throughout the salt. Selective dissolving is possible in this case. With solar salts, the $CaSO_4$ is more evenly distributed (or even on the surface of the particles) and is likely to be present as gypsum ($CaSO_4.2H_2O$), which is much more rapidly soluble. Rapid dissolvers tend to be less selective with solar salts because gypsum dissolves more rapidly than anhydrite.

Certain additives, used with conventional dissolvers, inhibit the solubility of $CaSO_4$. The additives commonly used to prevent dissolution of sulfates are phosphate compounds, detergent types, or a combination of the two. These depend on the fact that sulfates are present as $CaSO_4$ ($MgSO_4$) and are in their action suppressors of calcium (magnesium) solubility. It is practical to use them only at very low concentrations. They are, therefore, most effective with rock salts, where a small amount is sufficient to coat a particle of anhydrite with insoluble calcium compounds. By forming an insoluble coating on the surface of the discrete anhydrous $CaSO_4$ particle, the $CaSO_4$ is prevented from reaching equilibrium with the brine. When $CaSO_4$ is widely dispersed or is present as gypsum, these agents are found to be much less effective. Furthermore, their additions may be incompatible with the membrane and adversely affect membrane cell operation.

SUMMARY OF THE INVENTION

In a membrane-type chlor-alkali plant, a soluble calcium compound is added to the salt-depleted brine from the cells before the brine is a resaturated through contact with salt. This controls sulfate concentration by preventing dissolution of sulfate impurities found in the salt and so avoids deleterious influence on membrane performance.

BRIEF DESCRIPTION OF THE DRAWING

The single FIGURE of the drawing is a schematic representative of a brine loop in a membrane-cell chlor-alkali plant.

DETAILED DESCRIPTION

The addition of a source of calcium ion, a cation of an insoluble sulfate, to an alkali metal chloride solution from a membrane cell, before it is resaturated for recycle to the cells, reduces or eliminates the dissolution of sulfate impurities accompanying the salt. A schematic of a brine loop in a membrane-cell chlor-alkali plant is shown in the drawing. Exceptionally pure brine 1 is fed to the anolyte compartments of a battery of membrane cells 2. A voltage is imposed across the cells thereby evolving chloride ions at the anode and alkali metal hydroxide ions at the cathode. The chloride ions are discharged to form chlorine gas 3. The alkali metal ions, for example sodium or potassium, are transported through the membranes to the catholyte side (not shown). In the catholyte compartment hydrogen ions, from water, are discharged to form hydrogen gas. The remaining hydroxyl ions, together with the alkali metal ions, form the second principal product, an alkali metal hydroxide.

The salt-depleted brine 4 leaves the anolyte compartments of the cells 2 saturated with chlorine 5, which is removed in dechlorinator 6 before the further processing. Typically in dechlorinator 6, an acid 7, for example hydrochloric acid, is added and a vacuum applied to remove the bulk of the dissolved chlorine 5. The salt-depleted brine leaving the membrane cells may be further diluted with water before entering the saturator 10.

The dechlorinated brine, via conduits 8 and 9, enters a saturator 10 where it is saturated by contact with salt 11 in preparation for recycle to the cells 2. Finally, impurities introduced along with the salt 11 may be removed from the saturated brine 12 in a primary treatment unit 13. In a conventional system, the chief impurities are alkaline earths and heavy metals. Diaphragm and mercury cell brine systems usually base their primary treatment 13 on chemical precipitation and gravity settling in a clarifier. For example, a source of carbonate ions 14 can be added to form the calcium carbonate stream 15 ($CaCO_3$), which is precipitated. These will leave a few parts per million (ppm) of hardness in saturated brine stream 16 exiting the primary treatment unit 13. With membrane cells, the latest technology would supplement this primary treatment with ion exchange 17 to reduce the hardness to less than 0.1 ppm. The resulting purified brine 1 is fed to the cells 2.

Membrane cells are also sensitive to the presence of sulfate in the brine. Sulfate is introduced into the system with the salt 11, and tends to remain in the system. Thus, if sulfate is continually introduced, its concentration increases and at some point it is necessary to provide a purge stream through which sulfate can leave the system. One method which has been employed is to treat the saturated brine with a calcium compound to precipitate calcium sulfate, which is separated by settling and filtration. This requires a large settling and filtration system.

According to the present invention a source of calcium ions (e.g., calcium chloride 18) is added to the salt-depleted brine 4 or 8, which contains an acceptable steady state level of sulfate. The source of calcium ions can be added to the salt-depleted brine at any point after exiting the anolyte compartments of the membrane cells 2 and prior to entry into the saturator 10. The addition of a source of calcium ions at this point in the process is contrary to the teaching of the prior art. This addition produces the unexpected result of controlling sulfate concentration entering the cells 2 more effectively than does the addition of a source of calcium ions to the saturated solution exiting the saturator as taught by the prior art.

It is not necessary to add sufficient calcium to actually precipitate the sulfate at this point. However, the quantity of calcium added is sufficient to effectively prevent excessive dissolution of calcium sulfate in the saturator 10. As a result, essentially no new sulfate enters the system once the desired steady state concentration of sulfate is achieved. There is little or no need for a purge stream with the increased capital and operating costs attendant thereto. Additional large-scale equipment (e.g. clarifier) is not required. It is a purpose of this invention to provide a method for selecting an appropriate level of calcium addition such that an acceptable steady state sulfate concentration in the system is achieved.

It is not possible to produce a supersaturated solution by contact with more solute already in the solid state. Increasing the calcium ion concentration will by the principle of the law of mass action reduce the maximum concentration of calcium sulfate which can result from the solution process. The concentration of dissolved calcium sulfate is approached from the dilute side. This is in contrast to being approached from the supersaturated side as in the conventional post-dissolution processes. There is no problem with kinetics of slow precipitation, reactions or filtration of extremely finely divided precipitates.

A sludge of undissolved calcium sulfate 19 will form in the saturator 10 and can be removed from the system. The calcium can be removed from the saturated brine by conventional primary treatment technology.

The source of calcium ion could, for simplicity, be calcium chloride ($CaCl_2$). This can be generated by treating the precipitated calcium carbonate ($CaCO_3$) in stream 15 with hydrochloric acid. Alternatively, the source of calcium ion could be calcium hydroxide (lime, $Ca(OH)_2$) if a quantity of hydrochloric acid sufficient to dissolve it is added in the dechlorinator 6.

The solubility of calcium sulfate in a sodium chloride brine solution is substantially greater than the solubility in water. The solubility of crystalline anhydrous calcium sulfate (i.e., anhydrite), in an increasingly concentrated sodium chloride brine, increases to a maximum of about 9 grams $CaSO_4$ per liter of brine at about 100 grams NaCl per liter of brine and then decreases.

Since one objective is to decrease the concentration of sulfate in the saturated brine, the solubility curves demonstrate that the saturator 10 should be operated at high sodium chloride concentrations. The present invention teaches an appropriate adjustment of added calcium ions depending upon the degree of sodium chloride concentration exiting the saturator.

It has been found that the maximum sulfate concentration present in the saturated brine 12 leaving the saturator 10 can be controlled by adding to the unsaturated brine 4 or 8 a quantity of calcium chloride 18 calculated by the following equation:

$$C=0.124[10^{[A \log (7.84S)+B]}-7.84(S-R)]$$

wherein $A=(-H)(0.00361)-0.812$ $B=(-H)(0.00828)+3.46$

In this equation, "S" is the allowable level of sulfate in the brine12 exiting from the saturator, expressed as grams of $Na_2SO_4$ per liter of brine; "R" is the actual steady state concentration of sulfate in the recycle brine 9 entering the saturator, expressed as grams of $Na_2SO_4$ per liter of brine; "H" is the salt concentration in the brine 12 exiting from the saturator, expressed as grams of NaCl per 100 cubic centimeters (100 CC) of brine; and "C" is the quantity of calcium ions (i.e., stream 18) which must be added to the salt-depleted brine exiting the membrane cells and prior to its introduction into the saturator 10, expressed as grams of $CaCl_2$ per liter of brine; all streams at about 15° C. or greater.

For example, shown in Table I and Table II below are two typical sets of operating conditions that can be achieved utilizing the above equation to calculate the required quantity of calcium ions. Table I is for a saturated 32.5 grams of NaCl per 100 cc of brine and Table II is for 20 grams of NaCl per 100 cc of brine.

TABLE I

| | Required Calcium (C) at 32.5 gm/cc (H) | | |
|---|---|---|---|
| S R = | 0 | 2 | 5 |
| 5 | 1.5 | 3.4 | 6.4 |
| 4 | 3.9 | 5.9 | 8.8 |
| 3 | 7.3 | 9.3 | 12.2 |
| 2 | 13.0 | 15.0 | 17.9 |
| 1 | 27.6 | 29.6 | 32.5 |

TABLE II

| | Required Calcium (C) at 20 gm/cc (H) | | |
|---|---|---|---|
| S R = | 0 | 2 | 5 |
| 5 | 4.7 | 6.6 | 9.5 |
| 4 | 7.7 | 9.7 | 12.6 |
| 3 | 12.1 | 14.0 | 16.9 |
| 2 | 19.5 | 21.4 | 24.3 |
| 1 | 38.8 | 40.5 | 43.4 |

Comparison of these two examples illustrate the advantage of operating at high brine concentration (H) to reduce the required amount of calcium ion addition (C) at a given desired sulfate level (S).

There are no real constraints on operating conditions. In practice, this invention would be applied at the conditions which normally prevail in the brine system. Because of the inverse solubility shown by $CaSO_4$ (anhydrite), it is preferable to apply the process at as high a temperature as possible, which favors the process of the present invention over the process of precipitation after resaturation.

The added calcium chloride specified by this equation will be adequate to achieve the desired suppression of sulfate concentration over the entire range of final brine concentrations and temperatures normally practiced in saturator operation. Further, the quantity of added calcium chloride is sufficient regardless of whether the solid calcium sulfate is gypsum or anhydrite.

"C" is the maximum amount required to control "S". It may be found under some circumstances, for example when the solid phase is anhydrite and the higher temperature ranges are being employed, a smaller amount of calcium chloride may be sufficient. This is due to the fact that the solubility of $CaSO_4$ (anhydrite) decreases as temperature increases.

What is claimed is:

1. In a method of electrolyzing an alkali metal chloride brine comprising an alkali metal salt solution with sulfate impurities in a membrane cell having at least an anolyte compartment containing an anode and a catholyte compartment containing a cathode, which method comprises feeding the brine solution to the anolyte compartment, imposing a voltage across the cell thereby evolving chlorine at the anode and evolving an alkali metal hydroxide at the cathode after migration of the alkali metal ion through the membrane into the catholyte compartment, removing the alkali metal salt-depleted brine solution from the anolyte compartment, separating the chlorine evolved at the anode from the alkali metal salt-depleted brine solution, resaturating the brine solution by contact with impure alkali metal chloride, treating the resaturated brine solution to remove impurities, and recycling the treated resaturated brine solution as feed to the anolyte compartment, the improvement which comprises adding a controlled amount of a source of calcium ion to the alkali metal salt-depleted brine solution, after the solution exits the anolyte compartment and prior to resaturation, followed by precipitation of calcium carbonate ($CaCO_3$) from the brine solution by introducing an alkali metal carbonate after resaturation of the alkali metal salt-depleted brine solution, whereby the concentration of sulfate entering the membrane cell is controlled.

2. The method of claim 1 wherein the alkali metal chloride is sodium chloride (NaCl) and the alkali metal hydroxide is sodium hydroxide (NaOH).

3. The method of claim 1 wherein the alkali metal chloride is potassium chloride (KCl) and the alkali metal hydroxide is potassium hydroxide (KOH).

4. The method of claim 1 wherein the source of calcium ion is calcium chloride ($CaCl_2$).

5. The method of claim 4 wherein the $CaCl_2$, the source of calcium ion, is recycled by treating precipitated calcium carbonate ($CaCO_3$) with acid to form $CaCl_2$.

6. The method of claim 5 wherein the acid is hydrochloric acid (HCl).

7. The method of claim 1 wherein the source of calcium ion is lime.

8. The method of claim 1 wherein the source of calcium ion is limestone.

9. The method of claim 1 wherein the alkali metal is sodium and the quantity of calcium ion added is calculated by the equation:

$$C=0.124[10^{A \log (7.84S)+B}]-7.84(S-R)]$$

wherein $A=(-H)\ (0.00361)-0.812$ $B=(-H)\ (0.00828)+3.46$ wherein "S" is the allowable level of sulfate in the brine exiting from the saturator, expressed as grams of $Na_2SO_4$ per liter of brine; "R" is the actual steady state concentration of sulfate in the recycle brine entering the saturator, expressed as grams of $Na_2SO_4$ per liter of brine; "H" is the salt concentration in the brine exiting from the saturator, expressed as grams of NaCl per 100 cubic centimeters (100 CC) of brine; and "C" is the quantity of calcium ions which must be added to the salt-depleted brine exiting the membrane cells and prior to its introduction into the saturator, expressed as grams of $CaCl_2$ per liter of brine; all streams at about 15° C. or greater.

* * * * *